United States Patent [19]

Kamata et al.

[11] 3,988,900

[45] Nov. 2, 1976

[54] METHOD OF RE-CONDITIONING AIR FROM CENTRAL AIR CONDITIONING SYSTEM AND AIR CONDITIONING UNIT TO CARRY OUT THE METHOD

[75] Inventors: Jyoji Kamata; Makoto Obata; Toshio Yamamoto; Shigeo Murase, all of Kadoma, Japan

[73] Assignee: Matsushita Electric Industrial Co., Ltd., Japan

[22] Filed: Nov. 12, 1975

[21] Appl. No.: 631,312

[30] Foreign Application Priority Data

Nov. 13, 1974 Japan ..... 49-137990[U]

[52] U.S. Cl. ..... 62/92; 62/419; 62/427; 98/33 A

[51] Int. Cl.[2] ..... F25D 17/06; F24F 13/00

[58] Field of Search ..... 62/92, 93, 415, 416, 62/427, 441, 442, 419, 159; 98/33 A

[56] References Cited

UNITED STATES PATENTS

| | | | |
|---|---|---|---|
| 2,817,217 | 12/1957 | Winkler et al. | 62/419 |
| 3,143,952 | 8/1964 | Simons | 98/33 A |
| 3,625,022 | 12/1971 | Johnson | 62/159 |
| 3,789,621 | 2/1974 | Inuzuka | 62/427 |
| 3,932,157 | 1/1976 | Bolton et al. | 62/427 |

*Primary Examiner*—Lloyd L. King
*Attorney, Agent, or Firm*—Robert E. Burns; Emmanuel J. Lobato; Bruce L. Adams

[57] ABSTRACT

A method of and an air conditioning unit for re-conditioning air supplied by a central air conditioning system and circulated through a space to be air conditioned, characterized in that water condensate produced by the evaporation of a refrigerant is vaporized by the heat of condensation of the refrigerant and is discharged from the ceiling chamber above the space air conditioned.

18 Claims, 5 Drawing Figures

METHOD OF RE-CONDITIONING AIR FROM CENTRAL AIR CONDITIONING SYSTEM AND AIR CONDITIONING UNIT TO CARRY OUT THE METHOD

BACKGROUND OF THE INVENTION

The present invention relates in general to air conditioning systems and, particularly, to a central air conditioning system of, for example, a single-duct design. More particularly, the present invention is concerned with a method of re-conditioning air which has been supplied from such a system and circulated through a space or spaces to be heated or cooled and further with an air conditioning unit for use with the system to carry out the method into practice.

While the central air conditioning system incorporating the improvement according to the present invention may be useful for the comfort cooling and heating of residential buildings and premises or for district air conditioning purposes, the same will prove advantageous particularly when installed in relatively large-sized, multiroom and/or multistory structures such as business, commercial, industrial, institutional or public buildings as will be understood as the description proceeds.

The capabilities, performance characteristics and dimensional details of a single-duct central air conditioning system are usually determined in the process of planning and designing the building in which the air conditioning system is to be installed. When the building is completed and transferred to the client or to tenants of the client from the contractor, it is usual that the users of the building have the floors or the existing compartments of each of the floors partitioned into sections and subsections depending upon the purpose for which the floor spaces are to be utilized. This results in change in the distribution of conditioning air supplied from the central conditioning unit and circulated through the spaces in the floors. The draughts of air into the spaces to be conditioned therefore vary from one section or subsection to another and, in the worst case, there will be such sections or subsections that are not directly ventilated from the distribution ductwork of the air conditioning system and are thus not or, at most, only poorly air conditioned. Such localized distribution of conditioning air also results from the sensible loads located in the space or spaces to be air conditioned, such as heat-emanating or heat-absorbing equipment and appliances, illumination for the space or spaces, and gains or losses of heat due to solar and sky radiation through the envelope of the building such as the roof structure, exterior walls, window panes and other kinds of skins.

To remedy the localized distribution of the conditioning air, it has been an ordinary practice to have the air distribution ductwork of the conditioning system locally re-arranged so as to compensate for the change in the load. This will compel the owner or the tenants of the building to incur extra expenses. Because, moreover, the ductwork is re-arranged only locally for the purpose of saving the cost and because of the fact that the central air conditioning unit per se is usually not re-adjusted or exchanged, the initially designed balance of the system tends to be destroyed even after the ductwork is re-arranged and, as a consequence, there will still exist sections or subsections which are only poorly air conditioned or the capacity of the system per se will become short of meeting the total demand of the building.

These problems may be solved if the air conditioning is "zoned" by arranging the single-duct system with supplementary terminal re-heating or re-cooling fan-coil units each to care for one or more of the zones or with manually or automatically controlled air-volume regulators to care for the individual sections or subsections. As an alternative, a dual-duct air conditioning system may be utilized in which warm and cold air from the central air conditioning unit served through parallel trunk supply systems is mixed by dampers delivering air properly proportioned to meet the different demands of the individual zones. Application of these types of air conditioning systems to large-sized buildings still presents a number of problems that must be solved. Among these problems are (1) the various kinds of losses of heat and pressure as caused by the transmission and delivery of the streams of the conditioning air through the ducts, the re-heating or re-cooling of air from the central unit, and the mixing of hot and cold air; (2) the increased installation and maintenance costs; (3) the complexity of the system arrangement; (4) the skilful techniques and the sustained, scrupulous maintenance and servicing required to enable the system to properly operate under varying environmental and weather conditions; and (5) the limited allowance for the extension and re-arrangement of the ductwork, the terminal devices, or the central unit.

To overcome all these problems that have been encountered in the prior art air conditioning systems for installation in large-sized buildings, the present invention proposes a central air conditioning system which is arranged with local air conditioning units mounted within ceiling structures above the spaces to be air conditioned, using the chamber in each ceiling structure as part of the air distribution ductwork. A ceiling mounted air conditioner per se is well known in the art as from U.S. Pats. Nos. 2,682,757, 2,770,955, 2,817,217 and 3,625,022. Problems are, however, pointed out in respect of any of the ceiling attic installed air conditioners taught in these patents in that the heat exchange efficiencies on both heating and cooling cycles are low because outdoor air is used, without being pre-heated or precooled, as a source of heat or a medium to be heated by the rejected air and in that additional cost and space are required for the installation of the piping to drain off water condensate produced onto the condenser coil of the conditioner.

SUMMARY OF THE INVENTION

The present invention contemplates provision of a solution to the above-mentioned drawbacks inherent in the prior art single-duct central air conditioning systems and ceiling or attic mounted air conditioners. While, however, the improvement according to the present invention will be most advantageously exploited when combined, in effect, with a central air conditioning system of a single-duct type, it should be borne in mind that the present invention may be realized in combination with a central air conditioning system of any other type or independently of a central conditioning system of any type.

It is, therefore, an important object of the present invention to provide a method of re-conditioning air supplied from a central air conditioning system of, for example, a single-duct type, and circulated through a space or spaces to be air conditioned.

It is another important object of the present invention to provide an air conditioning unit to be combined, in effect, with a single-duct central air conditioning system for remedying or compensating for the intrinsic restrictions of the central air conditioning system.

It is still another important object of the present invention to provide an air conditioning unit for use with a central air conditioning system of, for example, a single-duct type for providing ease of local control and modification or "zoning" of conditioning air depending upon the specific demands of individual spaces to be air conditioned.

It is still another important object of the present invention to provide a single-duct central air conditioning system arranged with local air conditioning units which are mounted within ceiling structures of a building and which can dispense with the piping for the drainage of water condensate from the local units.

It is still another important object of the present invention to provide a single-duct central air conditioning system arranged with local air conditioning units each provided with a device which is adapted to vaporize the water condensate in an "on-the-spot" fashion, viz., without using piping arrangement and which will thus do justice to any placement of each local conditioning unit within a ceiling structure of a building.

It is still another important object of the present invention to provide a single-duct central air conditioning system arranged with local air conditioning units in which considerations are given to prevent or minimize condensation of moisture on to the condensers of the units during cooling and heating cycles, particularly the cooling cycles of the units.

It is still another important object of the present invention to provide a single-duct central air conditioning system arranged with local air conditioning units which are adjustable independently of each other as well as of the central conditioning system depending upon the latent and sensible loads located in individual zones to be air conditioned.

It is still another important object of the present invention to provide an air conditioning unit which is, in itself, easy and economical to manufacture, to install, to operate and to service and which will provide, when combined with a single-duct central air conditioning system, simplicity of construction, ease of installation, re-arrangement, extension, operation and servicing and economy of installation and maintenance of the central conditioning system.

It is, thus, a general and basic object of the present invention to provide an air conditioning system capable of maintaining excellent comfort at low cost under any load and environmental conditions in a relatively large-sized multiroom and/or multistory building.

In accordance with one important aspect of the present invention, there is provided a method for re-conditioning air supplied by a central air conditioning system and circulated through a space to be air conditioned in a building having a ceiling chamber over the space, comprising (1) producing a continuous stream of a refrigerant through a closed loop having cycles to evaporate and condense the refrigerant, (2) withdrawing out of the space into the ceiling chamber the air which has been circulated through the space, (3) inducing a first forced circulation of air within the ceiling chamber (4) exchanging heat between the first forced circulation of air and the stream of the refrigerant, (5) inducing a second forced circulation of air out of the space to be air conditioned and back into the space separately of the first forced circulation of air, (6) exchanging heat between the second forced circulation of air and the stream of the refrigerant which has exchanged heat with the first forced circulation of air, (7) collecting water condensate produced by the evaporation of the refrigerant, (8) bringing the collected water condensate into heat-conductive contact with the heat resulting from the condensation of the refrigerant for thereby vaporizing the water condensate in the ceiling chamber and (9) withdrawing the resultant water vapor out of the ceiling chamber by the first forced circulation of air.

In accordance with another important aspect of the present invention, there is provided an air conditioning unit for use with a central air conditioning system for installation in a building having at least one space to be air conditioned and a ceiling structure formed with a ceiling chamber between upper and lower horizontal members and provided with means for withdrawing out of the space to be air conditioned into the ceiling chamber the air which has been circulated through the space, comprising an air-to-air heat pump including a closed loop filled with a refrigerant and having cycles to evaporate and condense the refrigerant, first circulation inducing means for inducing a first forced circulation of air within the ceiling chamber, second circulation inducing means for inducing a second forced circulation of air out of the above-mentioned space and back into the space, first heat exchange means for exchanging heat between the first forced circulation of air and the stream of the refrigerant circulated through the closed loop, second heat exchange means for exchanging heat between the second forced circulation of air and the stream of the refrigerant which has exchanged heat with the first forced circulation of air, collecting means for collecting water condensate produced by the evaporation of the refrigerant, and vaporizing means for bringing the collected water condensate into heatconductive contact with the heat resulting from the condensation of the refrigerant for vaporizing the water condensate, the first circulation inducing means and the vaporizing means being positioned within the ceiling chamber.

BRIEF DESCRIPTION OF THE DRAWINGS

Other features and advantages of the present invention will become apparent from the following description taken in conjunction with the accompanying drawings in which.

Figure 1:
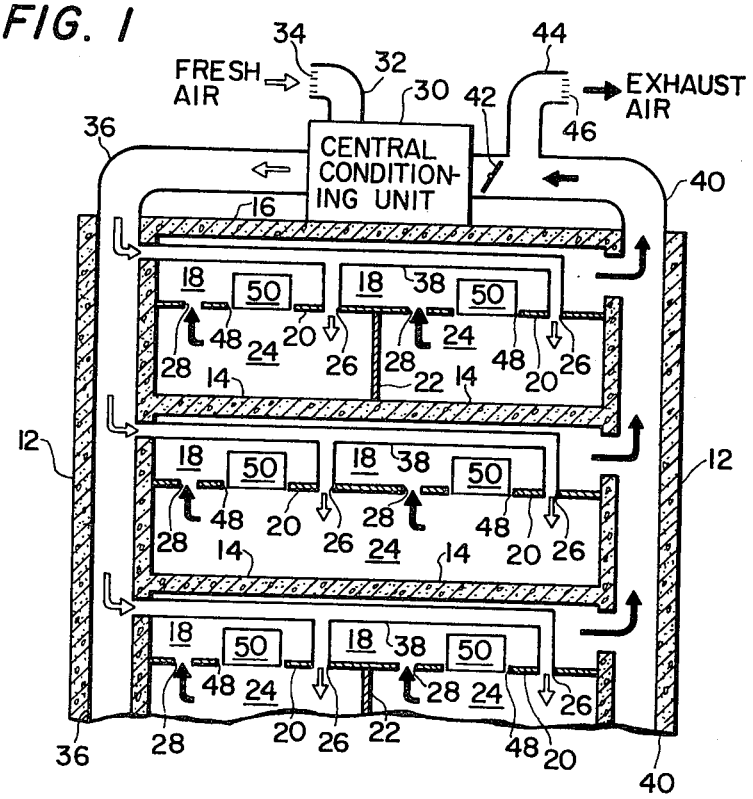
FIG. 1 is a schematic vertical sectional view of a building structure installed with a single-duct central air conditioning system arranged with local air conditioning units according to the present invention.

Referring to the drawings, first to FIG. 1, reference numeral 10 designates a multistory, multiroom building (only an upper portion of which is shown) equipped with a single-duct central air conditioning system. The building 10 is assumed, by way of example, as being of the concrete construction and is shown comprising a load-carrying frame composed of external vertical walls 12 of reinforced concrete and floor and roof structures 14 and 16 each of which may be made up of a slab of concrete on beams of concrete or steel as is customary in the art of architecture. In each of the spaces thus formed between the floor and roof structures 14 and 16 is arranged a ceiling structure having a ceiling chamber 18 formed between a horizontal ceiling panel 20 and the underside of the floor or roof structure 14 or 16 immediately above the ceiling panel 20. The space between each of the underside of each ceiling panel 20 and the floor structure 14 underneath the ceiling panel is shown divided by a vertical partition member 22 into rooms 24 which are spatially separate from each other. The ceiling panel 20 above each of the rooms 24 is formed with openings 26 and 28 for the ventilation of conditioning air circulated in each room 24 as will be described. The above described construction of the building 10 is merely for the purpose of illustration and is of little importance to the present invention except in that the building has a ceiling structure which comprises upper and lower horizontal members constituted, in the arrangement shown, by the floor or roof structure 14 or 16 and the ceiling panel 20, respectively, and which has a ceiling chamber 18 formed between the upper and lower horizontal members.

The single-duct central air conditioning system installed in the building 10 thus constructed comprises a central air conditioning unit 30 which is shown mounted on the top of the roof structure 16 and having an air intake duct 32 with a louver arrangement 34 through which to draw fresh air into the unit 30. As is well known in the art, the central air conditioning unit 30 has built therein filters for fresh and recirculated air, fans, a cooling coil, a motor-driven refrigeration compressor, an air-cooled or water-cooled condenser, a mixing chamber for mixing fresh and recirculated air, and so forth, though not shown in the drawings. The system further comprises ductwork which is shown to consist of, in addition to the above mentioned air intake duct 32, a main supply duct 36 leading from the delivery side of the conditioned air supply fan (not shown) in the unit 30, a plurality of distribution ducts 38 branched from the main supply duct 36, and a return duct 40 in communication with the above mentioned mixing chamber across an automatically controlled recirculation air damper 42, and an air discharge duct 44 which is branched from the return duct 40 upstream of the damper 42 and which is open to the atmosphere through a louver arrangement 46. Each of the distribution ducts 38 branched from the main supply duct 36 extends through each of the ceiling chambers 18 and terminates in the openings 26 in the ceiling panel 20 at the bottom of the particular ceiling chamber 18 as shown. On the other hand, the return duct 40 is in communication with the ceiling chambers 18 through openings 46 which are formed in an inner wall portion of the exterior vertical wall 12.

When the central air conditioning system thus arranged is in operation either on the cooling or heating cycle thereof, cold or hot air delivered from the central conditioning unit 30 into the main supply duct 36 is directed into the branch ducts 38 and blows through the openings 26 at the terminals of the branch ducts 38 downwardly into the individual rooms 24 to be air conditioned. The cold or hot air is circulated through each of the rooms 24 and extracts or liberates heat from or into the latent and sensible loads in the room. The stream of air thus warmed or cooled in each room 24 is withdrawn from the room through the opening or openings 28 in the ceiling panel 20 above the room 24 and enters the ceiling chamber 18. Air thus entering each of the ceiling chambers 18 is passed into the return duct 40 and is in part discharged as exhaust air into the atmosphere through the air discharge duct 44 and in part recirculated into the central conditioning unit 30 across the recirculating air damper 42 for reuse of the heat in the recirculated air. If desired, the distribution ducts 38 may be arranged to be open into some or all of the rooms 24 through openings (not shown) formed in an inner wall portion of the vertical wall 12 or, as an alternative to this arrangement, the main supply duct 36 may be arranged to be open direct into some or all of the rooms 24 through such openings, provided air blowing from such openings is capable of being uniformly circulated through each of the rooms 24 or if the structural or dimensional details of the rooms call for such a modified arrangement. It is, however, of special importance in the present invention that each of the ceiling chambers 28 be arranged to provide communication between each of the rooms 24 to be air conditioned and the return duct 40 and can thus be utilized as part of the ductwork for withdrawing air from each room 24.

In a conventional single-duct central air conditioning system, the draughts of conditioning air fed into the individual rooms 24 are, in principle, substantially uniform throughout the rooms. As previously pointed out, however, the latent and sensible loads notably vary from one of the rooms or zones to another due to the gains or loses of heat as caused by, for example, placement of heat-emanating or heat-absorbing equipment and appliances, illumination for the rooms or zones and solar and sky radiation. It will therefore happen that the draughts of conditioning air into some of the rooms become short of providing sufficient comform in the rooms. This problem becomes more serious if the rooms 24 are partitioned into smaller sections or subsections so that some of the sections or subsections are not in direct communication with the air inlet and outlet openings 26 and 28 in the ceiling panels 20. To overcome the problem inherent in the central air conditioning system of the single-duct design, the present invention proposes to provide supplementary air conditioning means adapted to reheat or re-cool room air independently of the central system and depending upon the total load in each of the rooms to be air conditioned.

To achieve this purpose, each of the ceiling panels 20 is formed with an opening 48 and a local air conditioning unit 50 is positioned in the ceiling chamber 18 above the opening 48. The local air conditioning units 50 may be provided for all of the rooms 24 as shown or the sections and subsections of the rooms but it is preferably, for the purpose of reducing cost of installation and maintenance, to have the units provided only for those rooms or the sections or subsections of the rooms which can not be sufficiently air conditioned by the conditioning air supplied by the central system alone for the previously mentioned reasons. Details of a preferred construction of the unit 50 are illustrated in FIG. 2.

Figure 2:
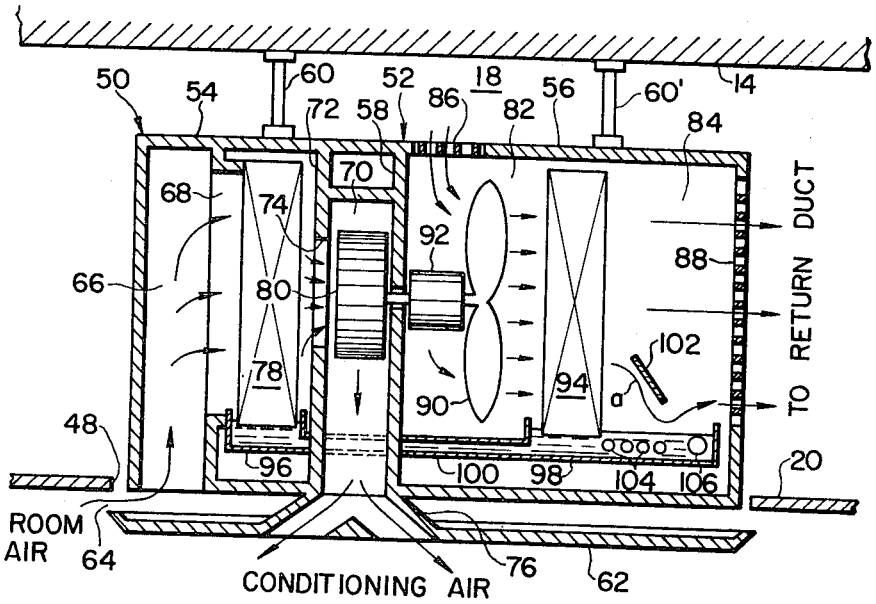
FIG. 2 is a vertical sectional view showing a preferred embodiment of the present invention.

Referring to FIG. 2, the local air conditioning unit 50 is constituted by an air-to-air heat pump and comprises a casing 52 consisting of conditioning and heat-transfer sections 54 and 56 which are horizontally juxtaposed and which are separated from each other by a vertical partition member 58 forming part of the casing 52. The casing 52 is suspended from the underside of the floor structure 14 by means of brackets 60 and 60′ and preferably has its lower end located in the above mentioned opening 48 in the ceiling panel 20 as shown. The casing 52 has integrally formed therewith or fixedly attached thereto a horizontal bottom member 62 which is substantially coextensive with the opening 48 in the ceiling panel 20. The bottom member 62 is downwardly spaced apart from the bottom end of the casing 52 and forms a gap 64 between the lower end of the conditioning section 54 and the upper face of the bottom member 62.

The conditioning section 54 of the casing 52 consists of an air inlet chamber 66, a heat-exchange chamber 68 and an air outlet chamber 70 which are horizontally arranged in series and which are constantly in communication with each other with the heat-exchange chamber 68 located between the air inlet and outlet chambers 66 and 68. The air inlet chamber 66 has an open bottom end and communicates through the open bottom end with the above mentioned gap 64 and, through the gap 64, with the space under the ceiling panel 20, the space being one of the rooms 24 shown in FIG. 1 or a section or a subsection forming part of the room. The heat-exchange chamber 68 has an input or windward side contiguous to the leeward side of the air inlet chamber 66 and an output or leeward side communicating with the air outlet chamber 70. Between the heat-exchange chamber 68 and the air outlet chamber 70 is positioned a vertical wall member 72 which is integral with or fixedly jointed to the casing 52. The wall member 72 is formed with a preferably circular opening 74 through which communication is provided between the chambers 68 and 70. The wall member 72 thus formed with the opening 74 is useful for concentrating the stream of air to flow from the heat-exchange chamber 68 into the air outlet chamber 70 as will be understood as the description proceeds but, if desired, the wall member 72 may be disposed with for providing direct and unrestricted communication between the chambers 68 and 70. The previously mentioned horizontal bottom member 62 disposed underneath the casing 52 is formed with a diffuser portion 76 which is downwardly open into the space under the ceiling panel 20. The air outlet chamber 70 has an open bottom end communicating with the space under the ceiling panel 20 through the diffuser portion 76 of the bottom member 62.

Within the heat-exchange chamber 68 is positioned a heat-exchanger 78 which may be constituted by a finned coil ordinarily used as a heating or cooling coil in an air-to-air heat pump. Though not shown in the drawings, the heat-exchanger 78 is connected through a suitable shift valve (usually a four-position valve) between a compressor and an expansion valve by means of suitable piping arrangement and has passed therethrough a refrigerant in a direction toward or away from the compressor, as is customary in the art of heat pumps. On the other hand, the air outlet chamber 70 has accommodated therewithin a motor-driven centrifugal or paddle-wheel fan 80 rotatable about a horizontal axis substantially parallel with the direction of the flow of air to be induced from the heat-exchange chamber 68 into the air outlet chamber 70 through the opening 74 in the wall member 72 or, preferably, in line with the center axis of the circular opening 74 as shown. The centrifugal fan 80 is thus adapted to induce a forced circulation of air out of the space below the ceiling panel 20, through the conditioning section 54, and into the above mentioned space.

The heat-tranfer section 56 consists of an air inlet chamber 82 and a heat-exchange chamber 84 which are constantly in communication with each other. The air inlet chamber 82 is open at the top thereof into the ceiling chamber 18 through a grille 86. On the other hand, the heat-exchange chamber 84 has an input or windward side contiguous to the leeward side of the air inlet chamber 82 and an output or leeward side open to the ceiling chamber 18 through a grille 88. The air inlet chamber 82 has accommodated therein an axial-flow fan 90 having a horizontal axis substantially parallel with the flow of air to be induced through the heat-exchange chamber 84 and preferably in line with the axis of rotation of the centrifugal fam 80 in the conditioning section 54. The axial-flow fan 90 is thus adapted to induce a forced circulation of air out of the ceiling chamber 18, through the heat-transfer section 56 and into the ceiling chamber 18. Both the centrifugal fan 80 and the above mentioned axial-flow fan 90 are driven by a motor 92 which is shown positioned within the air inlet chamber 84 of the heat-transfer section 56 and which is mounted on the previously mentioned partition member 58 separating the conditioning and heat-transfer sections 54 and 56. Within the heat-exchange chamber 84 of the heat-transfer section 56 is mounted a heat-exchanger 94 which may be constituted by a finned coil. As is customary in the art, the heat-exchanger 94 is connected through the previously mentioned shift valve between the compressor and the expansion valve by suitable piping arrangement similarly to the heat-exchanger 78 in the conditioning section 54, though not shown in the drawings.

The air conditioning unit 50 thus constructed and arranged is in most respect similar to the existing air-to-air, refrigerant-flow-reversible heat pump, having a closed refrigerant circuit consisting of the heat-exchangers 78 and 94 which are in communication with each other through the refrigerant compressor, shift valve and expansion valve (or two expansion valves one of which operates as a check valve when the other operates as the expansion valve).

When, now, the single-duct central air conditioning system is operating on the cooling cycle thereof for providing comfort cooling as during the summer season, the shift valve of the heat pump constituting the local air conditioning unit 50 is set so that the heat-exchanger 78 in the conditioning section 54 is connected to the suction side of the compressor for acting as a refrigerant evaporator and the heat-exchanger 94 in the heat-transfer section 56 is connected to the delivery side of the compressor for acting as a refrigerant condenser. As a consequence, the compressor delivers the hot compressed refrigerant of the gaseous phase through the shift valve to the condenser or the heat-exchanger 94 in the heat-transfer section 56, in which the refrigerant gas is condensed into a liquid state and gives up the latent heat of condensation of the air in contact with the heat-exchanger. From the heat-exchanger 94 serving as the condenser, the liquid refrigerant flows through the expansion valve to the heat-exchanger 78 in the conditioning section 54, in which the liquid refrigerant is changed into a gas, absorbing the heat of evaporation from the air in contact with the heat-exchanger 78 serving as the evaporator. From the heat-exchanger 78, the refrigerant gas returns through the shift valve to the compressor so as to repeat the above described cycle. When, thus, the motor 92 of the conditioning unit 50 is energized and the fans 80 and 90 in the conditioning and heat-transfer sections 54 and 56, respectively, are initiated into action under these conditions, forced circulations of air are induced in both of the conditioning and heat-transfer sections 54 and 56 as previously mentioned. By reason of the suction induced by the centrifugal fan 80 in the conditioning section 54, room air in the space under the ceiling panel 20 is drawn into the air inlet chamber 66 of the section 54 through the gap 64 and then into the heat-exchange chamber 68, in which the room air is cooled by the heat-exchanger 78 serving as the refrigerant evaporator so as to extract heat from the air passed therethrough. The air thus re-cooled is forcibly withdrawn out of the heat-exchange chamber 68, through the air outlet chamber 70 and through the diffuser portion 76 of the bottom member 62 into the space under the ceiling panel 20 and cools the space. On the other hand, the air in the ceiling 18 is drawn into the air-inlet chamber 82 of the heat-transfer section 56 by the stream of air induced by the axial-flow fan 90 and is passed through the heat-exchanger 94 serving as the refrigerant condenser to liberate heat into the air. The air thus re-heated in the heat-transfer section 56 is discharged into the ceiling chamber 18 from the output or leeward side of the heat-exchange chamber 84. The air introduced into the heat-transfer section 54 from the ceiling chamber 18 has once been cooled by the central conditioning system and, for this reason, remains at a relatively low temperature as compared with outdoor air although the same has been warmed by the load in the space air conditioned. This means that the heat-exchanger 94 in the heat-transfer section 56 is subjected to a relatively low load and is therefore enabled to provide a relatively high heat exchange efficiency between the refrigerant and the air passed through the heat-exchanger 94. The warm air discharged from the heat-transfer section 56 is passed, together with the air withdrawn from the other spaces, into the return duct 40 of the central conditioning system through the ceiling chamber 18 (FIG. 1).

When, on the other hand, the central air conditioning system is operating on the heating cycle thereof for providing comfort heating as during the winter season, the local air conditioning unit 50 is operated so that the heat-exchanger 78 in the conditioning section 54 is connected to the delivery side of the refrigerant compressor for acting as a refrigerant condenser and the heat-exchanger 94 in the heat-transfer section 56 is connected to the suction side of the compressor for acting as a refrigerant evaporator. As a consequence, the compressor delivers hot refrigerant gas through the shift valve to the condenser or the heat-exchanger 78 in the conditioning section 54, in which the refrigerant gas is condensed into a liquid state and gives up the latent heat of condensation to the air passed through the heat-exchanger 78. From the heat-exchanger 78 thus serving as the condenser, the liquid refrigerant flows through the expansion valve to the heat-exchanger 94 in the heat-transfer section 56, in which the liquid refrigerant is changed into a gas, absorbing the heat of evaporation from the air in contact with the heat-exchanger 94 serving as the evaporator. From the heat-exchanger 94, the refrigerant gas returns through the shift valve to the compressor so as to repeat the cycle. When the fans 80 and 90 in the conditioning and heat-transfer sections 54 and 56, respectively, are driven by the motor 92 under these conditions, forced circulations of air are induced through the sections 54 and 56 as during the cooling cycle. The room air drawn into the conditioning section 54 is therefore warmed by the heat-exchanger 78 serving as the refrigerant condenser and liberating heat into the air passed through the heat-exchange chamber 68. The air thus re-heated is forcibly withdrawn from the heat-exchange chamber 68, through the air outlet chamber 70 and through the diffuser portion 76, into the space under the ceiling panel 20 and warms the space. On the other hand, the air drawn from the ceiling chamber 18 into the air inlet chamber 82 of the heat-transfer section 56 by the axial-flow fan 90 is cooled by the heat-exchanger 94 serving as the refrigerant evaporator to extract heat from the air. The air thus re-cooled in the heat-transfer section 56 is discharged into the ceiling chamber 18 from the output or leeward side of the heat-exchange chamber 84 and is passed, together with the air withdrawn from the other spaces, into the return duct of the central conditioning unit as during the cooling cycle. The air introduced into the heat-transfer section 56 from the ceiling chamber 18 is warmed by the central conditioning system and, in most cases, further by sensible loads in the spaces air conditioned and has a higher temperature than that of outdoor air especially in the cold seasons. This means that the heat-exchanger 94 serving as the refrigerant evaporator is subjected to a relatively low load and is, for this reason, enabled to provide a relatively high heat extraction efficiency between the refrigerant and the air passed through the heat-exchanger 94. The refrigerant for use in the air conditioning unit 50 may therefore be of a nature having a relatively high evaporation temperature as compared with a refrigerant to be used in a conventional air-to-air heat pump using outdoor air as a source of heat during the heating cycle.

The local air conditioning unit 50 may appear, as far as its construction and arrangement thus far described is concerned, essentially similar to the conventional air-to-air heat pump for comfort cooling and heating purposes but it should be noted that the air conditioning unit 50 is distinct from prior art heat pumps in that the unit is so arranged in combination, in effect, with a single-duct central air conditioning system so as to exchange heat with air which has once been heated or cooled by the central air conditioner and which has been withdrawn from the conditioned space or spaces into the ceiling chamber utilized to form part of the ductwork or more particularly of the return duct of the central conditioning system.

When the heat-exchanger 78 in the conditioning section 54 is acting as the refrigerant evaporator during the cooling cycle of the air conditioning unit 50, moisture contained in the room air drawn into the conditioning section 54 tends to be condensed onto the surfaces of the heat-exchanger 78. The water condensate flows down the surfaces of the fins of the heat-changer 78 and would reach the bottom of the casing 50, dripping down into the space below the conditioning unit unless suitable means is provided to prevent this from occurring. It has therefore been an ordinary practice in the art of air conditioners and heat exchangers to have a drain sump positioned below the heat exchanger for collecting the water condensate and to conduct the collected water condensate out of the heat exchange by the use of a piping arrangement. As previously pointed out, however, provision of such a piping arrangement not only requires additional cost and space for the installation thereof but restricts the locations available for the installation of the air conditioning unit.

To eliminate these problems encountered in the conventional air conditioners and heat exchangers, the local air conditioning unit 50 shown in FIG. 2 comprises, in addition to the members and units thus far described, a first open-top-vessel or collecting basin 96 which is positioned within the heat-exchange chamber 68 in the conditioning section 54 and immediately below the heat-exchanger 78 and a second open-top vessel or vaporizing basin 98 which is positioned within the heat-exchange chamber 84 in the heat-transfer section 56 and located in part immediately below the heat-exchanger 94 and in part on the output or leeward side of the heat-exchanger 94. The collecting and vaporizing basins 96 and 98 are connected together by suitable passageway means such as a conduit 100 which is open at one end into the bottom of the interior of the collecting basin 96 and at the other end into the bottom of the interior of the vaporizing basin 98. The bottom end of the interior of the vaporizing basin 98 has a level which is not higher than the level of the bottom end of the interior of the collecting basin 96 so that the water condensate collected in the latter is constantly allowed to flow into the former through the conduit 100. The collecting and vaporizing basins 96 and 98 are, furthermore, shown to be so positioned relative to the heat-exchanger 78 and 94, respectively, in such a manner that the lower ends of the heat-exchangers 78a nd 94 are lower than the top ends of the basins 96 and 98 and may accordingly be immersed in the water stored in the basins 96 and 98, respectively. If desired, the conduit 100 may be replaced with an open-top channel (not shown) which may be arranged essentially similarly to the conduit 100. During the cooling cycle of the air conditioning unit 50, the heat-exchanger 94 in the heat-transfer section 56 acts as a refrigerant condenser and emanates heat of condensation. The heat is transferred to the water in the vaporizing basin 98 in part by the stream of hot air flowing over the surface of the water from the output or leeward side of the heat exchanger 94 and in part by direct contact between the lower end of the water in the basin 98 and the heat-exchanger 94 having its lower end immersed in the water. To enable the water in the vaporizing basin 98 to be vaporized at an increased rate, a wind deflecting plate 102 may be positioned over the vaporizing basin 98 and on the leeward or output side of the heat-exchanger 94 so that a portion of the stream of air issuing the heat-exchanger 94 is forcibly guided or deflected downwardly toward the surface of the water stored in the basin 98 as indicated by an arrow*a*. The deflecting plate 102 may be fixedly connected to the casing 52 or may be arranged to be angle adjustable with respect to the direction of the flow of air from the heat-exchanger 94 and the surface of the water stored in the vaporizing basin 98. The vaporizing efficiency of the water in the basin 98 may be further increased if a hot pipe 104 arranged to be heated during both the cooling and heating cycles of the conditioning unit 50 is disposed within the vaporizing basin 98 so that the water stored in the basin 98 is positively evaporated by the heat transferred thereto from the hot pipe 104 which is immersed in the water or located slightly above the surface of the water depending upon the level of the water in the basin 98. The hot pipe 104 may be part of the piping arrangement connected to the delivery side of the refrigerant compressor of the conditioning unit 50 or may be branched from such a piping arrangement. The hot pipe 104 in the vaporizing basin 98 is preferably arranged in coiled form to add to the area of the surface of contact between the pipeline and the water. For the purpose of preventing the water from overflowing from the vaporizing basin 98, there may be further provided emergency vaporizing means responsive to an impending overflow condition of the water in the basin 98. The emergency vaporizing means is shown constituted by an electric heater 106 positioned within the vaporizing basin 98 and is connected to an external source of power (not shown). In the event an unusually increased quantity of water condensate is produced onto the heat-exchanger 78 in the conditioning section 54 as may be caused when the room air drawn into the conditioning section is unusually moist and, as a consequence, the water which has been stored in the vaporizing basin 98 can not be vaporized by the heat transferred from the heat-exchanger 94 and the pipeline 104 alone and is about to overflow from the basin 98, the electric heater 106 is automatically energized from the external power source and heats and vaporizes the water in the basin 98 until the impending overflow condition is eliminated. The water stored in the vaporizing basin 98 can thus be prevented from being overflown from the basin 98 and, accordingly, from dripping into the space below the ceiling panel 20 even when the level of the water in the basin 98 is raised unusually.

Tests were conducted to evaluate the vaporizing rate of the water from the vaporizing basin 98 when air in the ceiling chamber 18 has a temperature of 35° C and a relative humidity of 0.4. The tests were categorized in four different conditions including a condition (A) in which only the vaporizing basin 98 is provided and the wind deflecting plate 102 and the hot pipe 104 are dispensed with in the heat-transfer section 56, a condition (B) in which the vaporizing basin 98 is arranged with only the wind deflecting plate 102 and is thus void of the hot pipe 104, a condition (C) in which the vaporizing basin 98 is arranged with only the hot pipe 104 and is thus void of the wind deflecting plate 102 and a condition (D) in which the vaporizing basin 98 is arranged with both the wind deflecting plate 102 and the hot pipe 104. The electric heater 106 was kept deenergized in each of the tests. The tests revealed that the vaporizing rate of the water from the basin 98 is, on the average, about 180 ml per hour under the condition (A), about 270 ml under the condition (B), about 720 ml under the condition (C) and about 880 ml under the condition (D). From this it will be understood that the water condensate produced in the air conditioning unit 50 during the cooling cycle can be efficiently dissipated therefrom when the vaporizing basin 98 is arranged with the wind deflecting plate 102 or the hot pipe 104 or both although an acceptable water vaporization efficiency can be achieved when the wind deflecting plate 102 and the hot pipe 104 are dispensed with.

During the heating cycle of the air conditioning unit 50, on the other hand, the room air entering the ceiling chamber 18 is maintained at a relatively high temperature as previously noted and has a relatively low humidity by reason of the heat from the sensible load in the space air conditioned. It therefore follows that the air drawn into the heat-transfer section 56 has a relatively low dew temperature which is approximately 3° C when the air has a temperature of about 27° C and a relative humidity of about 0.3. If, therefore, the refrigerant for use in the conditioning unit 50 is selected to have an evaporation temperature lower than the dew point of the air in the ceiling chamber 18, viz., about 3° C for example, there will be produced substantially no water condensate onto the heat-exchanger 94 acting as a refrigerant evaporator during the heating cycle of the conditioning unit 50. The above specified dew temperature of air in the ceiling chamber 18 corresponds to the saturation pressure of about 5.63 kgs/cm$^2$ in absolute of the refrigerant or to the gauge pressure of about 4.63 kgs/cm$^2$. In the case of a plate-and-fin heat exchanger, the actual temperatures of the surfaces of the fins are usually higher, about 3° C., than the evaporation temperature of the refrigerant. In view of such a difference in temperature, the evaporation temperature of the refrigerant may be selected to be of the order of 4.1 kgs/cm$^2$ in gauge pressure. This will be achieved by selecting the capacity of the heat-exchanger 94 acting as an evaporator during the heating cycle, the draught of air supplied to the heat-exchanger 94 during the cooling cycle, the quantity of the refrigerant used, and/or the rate of circulation of the refrigerant through the heat-exchanger 94 during the heating cycle. The production of water condensate during the heating cycle of the conditioning unit 50 can be prevented in this fashion but even if water condensate happens to be produced on to the heat-exchanger 94 in the heat-transfer section 56, the water condensate flows down the surfaces of the fins of the heat-exchanger 94, is collected in the vaporizing basin 98 and is vaporized by the heat transferred from the hot pipe 104. Evaporation of the water from the basin 98 will be promoted by the stream of dry air flowing over the surface of the water from the output or leeward side of the heat-exchanger 94 and deflected downwardly by the wind deflecting plate 102. In view of the extremely small quantity of water condensate which is produced during the heating cycle, the hot pipe 104 may not be supplied with the hot refrigerant gas delivered from the compressor because the water condensate collected in the vaporizing basin 98 will be vaporized without being positively heated.

If desired, the collecting basin 96 may be positioned relative to the heat-exchanger 78 in the conditioning section 54 in such a manner that the top end of the basin 96 is not higher than the lower end of the heat-exchanger 78. Likewise, the vaporizing basin 98 may be positioned relative to the heat-exchanger 94 in the heat-transfer section 56 so that the top end of the basin 98 is not higher than the lower end of the heat-exchanger 94 above the basin 98. As an alternative, the vaporizing basin 98 may be located in its entirety on the output or leeward side of the heat exchanger 94, if desired.

Figure 4:
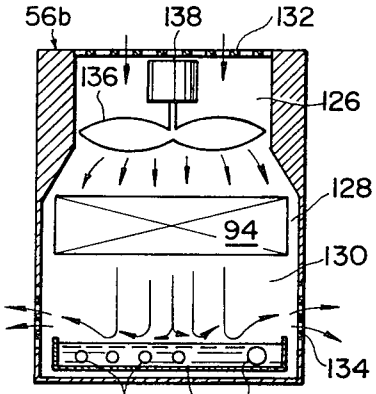
FIG. 4 is a view similar to FIG. 3 but shows part of still another preferred embodiment of the present invention.
Figure 3:
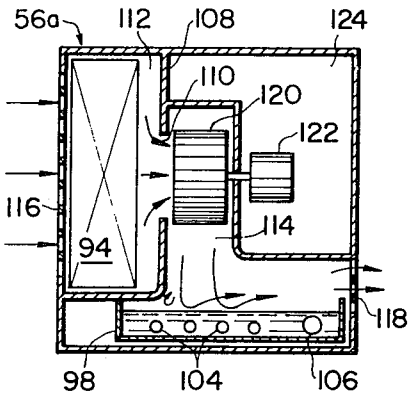
FIG. 3 is a vertical sectional view showing part of another preferred embodiment of the present invention.

FIGS. 3 and 4 illustrate modifications of the heat-transfer section 56 of the air conditioning unit 50 thus far described. Referring to FIG. 3, the heat-transfer section, now designated by 56*a*, is assumed to be combined with the conditioning section constructed and arranged largely similarly to the conditioning section 56 of the arrangement shown in FIG. 2 except in that the centrifugal fan 80 in the conditioning section 54 is driven by a motor (not shown) which is proper to the fan 80.

The heat-transfer section 56*a* shown in FIG. 3 has a vertical partition member 108 formed with a preferably circular opening 110 and consists of heat-exchanger and air outlet chambers 112 and 114 which are horizontally in communication with each other through the opening 110 in the partition member 108. The heat-exchange chamber 112 has an input or windward side open to the ceiling chamber through a grille 116 and an output or leeward side contiguous to the opening 110 in the partition member 108. On the other hand, the air outlet chamber 114 has a windward portion contiguous to the opening 110 in the partition member 108 and a leeward portion located below the windward portion and horizontally open to the ceiling chamber through a grille 118. Within the heat-exchange chamber 112 is positioned a heat-exchanger 94 similar to its counterpart in the embodiment illustrated in FIG. 2 while the air outlet chamber 114 has accommodated therewithin a centrifugal or paddle-wheel fan 120. The centrifugal fan 120 is rotatable about a horizontal axis which is substantially parallel with the direction of the flow of air to be induced from the heat-exchange chamber 112 into the windward portion of the air outlet chamber 114 through the opening 110 in the partition member 108 or, preferably, in line with the center axis of the opening 110 as shown. The centrifugal fan 120 is thus adapted to induce a forced circulation of air from the ceiling chamber into the heat-transfer section 56*a* and back into the ceiling chamber. The fan 120 is driven by a motor 122 which is shown located within a motor chamber 124 forming part of the heat-transfersection 56*a*. At the bottom of the lower leeward portion of the air outlet chamber 114 is positioned the previously described vaporizing basin 98 provided with the hot pipe 104 and the electric heater 106. The vaporizing basin 98 is in communication with the water condensate collecting basin 96 in the conditioning section 54 shown in FIG. 2.

The heat-transfer section 56*a* shown in FIG. 3 is thus characterized in that the centrifugal fan 120 is located above the vaporizing basin 98 so that the draft of air induced by the fan 120 is totally directed toward the water stored in the basin 98. The stream of air is caused to impinge upon the surface of the water in the basin 98 and will produce ripples of the water, promoting the water to be vaporized by the heat in the stream of air which has been passed through the heat-exchanger 94 which serves as a refrigerant condenser during the cooling cycle of the conditioning unit. Vaporization of the water in the basin 98 is further promoted by the heat which will be transferred to the water from the hot pipe 104 and, under an impending overflow condition, further by the heat generated by the electric heater 106 as previously described with reference to FIG. 2. The water vapor thus produced over the vaporizing basin 98 is withdrawn substantially in horizontal direction from over the vaporizing basin 98 into the ceiling chamber together with the air which has been drawn into the heat-transfer section 56*a* from the coiling chamber. The motor 122 for driving the centrifugal fan 120 may be utilized also to drive the centrifugal fan 80 in the conditioning section 54 of the conditioning unit (FIG. 2).

Turning to FIG. 4, the heat-transfer section, now designated by 56*b*, consists of air inlet, heat-exchange and air outlet chambers 126, 128 and 130 which are vertically in communication with each other. The air inlet and outlet chambers 126 and 130 are located at the top and bottom, respectively, of the section **56*b* with the heat-exchanger chamber 128 located between the air inlet and outlet chambers 126 and 130. The air inlet chamber 126 has a top end open to the ceiling chamber through a grille 132 and the air outlet chamber 130 is horizontally open to the ceiling chamber through a grille or grilles 134. Within the air inlet chamber 126 is positioned an axial-flow fan 136 rotatable about a vertical axis and is driven for rotation by a motor 138. The motor 138 may be proper to the fan 136 or may also be in driving connection to the centrifugal fan 80 in the conditioning section 54 (FIG. 2). The previously described heat-exchanger 94 is located in the heat-exchange chamber 128, having an input or windward side located immediately below the fan 136 and an output or leeward side locsted over the air outlet chamber 130. The heat-exchanger 94 acts as refrigerant condenser and evaporator during the cooling and heating cycles, respectively, of the conditioning unit, as previously described with reference to FIG. 2. At the bottom of the air outlet chamber 134 is positioned the vaporizing basin 98 provided with the hot pile 104 and the electric heater 106. The vaporizing basin 98 is in communication with the water condensate collecting basin 96 in the conditioning section 54 of the conditioning unit (FIG. 2**).

In operation, air in the ceiling chamber is drawn into the air inlet chamber 126 through the grille 132 by the suction induced by the axial-flow fan 136 and is passed to the heat-exchanger 94. During the cooling cycle of the conditioning unit, the heat-exchanger 94 acts as a refrigerant condenser and thus warms up the air passed therethrough. The warmed air is forced to blow downwardly toward the surface of the water stored in the vaporizing basin 98 and promotes the water to vaporize in cooperation with the hot pipe 104 and, under an impending overflow condition, also with the electric heater 106. The water vapor thus produced is expelled substantially in horizontal direction from over the vaporizing basin 98 by the stream of air subsequently flowing toward the basin and is discharged from the air outlet chamber 130 through the grille 134. The heat-transfer section **56*b* shown in FIG. 4 is, thus, characterized in that the draught of air induced by the fan 136 is totally directed toward the water stored in the vaporizing basin 98, similarly to the arrangement illustrated in FIG. 3.**

Figure 5:
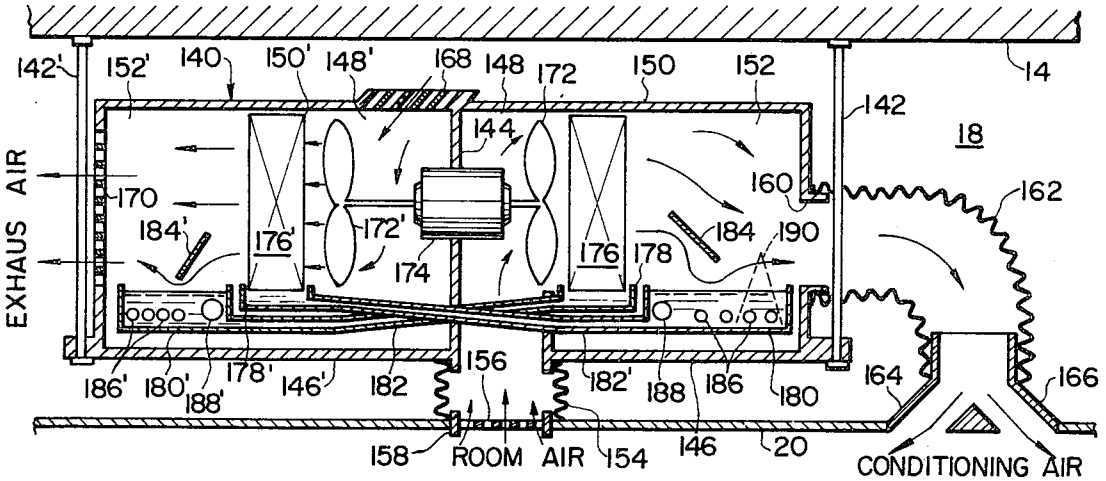
FIg. 5 is a view similar to FIG. 2 but shows a further preferred embodiment of the present invention.

While the casing 50 of the embodiment shown in FIG. 2 has a bottom part exposed to the space to be air conditioned, the local air conditioning unit embodying the present invention may be modified so that the casing of the conditioning unit is totally concealed above the ceiling panel. FIG. 5 shows such a modified embodiment.

Referring to FIG. 5, the air conditioning unit comprises a casing 140 which is positioned within a ceiling chamber 18 between a floor structure 14 and a ceiling panel 20 above the space to be air conditioned and which is suspended from the underside of the floor structure 14 by brackets 142 and 142' in such a manner that the casing 140 has its bottom end upwardly spaced apart from the ceiling member 20. The casing 140 is divided by a vertical partition member 144 into conditioning and heat-transfer sections 146 and 146' which are horizontally juxtaposed with each other on both sides of the partition member 144. The conditioning and heat-transfer sections 146 and 146' are constructed essentially similarly and respectively consist of air inlet chambers 148 and 148', heat-exchanger chambers 150 and 150', and air outlet chambers 152 and 152'. The air inlet chamber 148 of the conditioning section 146 has an open bottom end communicating with the space or room to be air conditioned through a bellows-type duct 154 having a lower end fixed to the ceiling panel 20 and open to the space or room through a grille 156 which is mounted in an opening 158 formed in the ceiling panel 20. The heat-exchanger chamber 150 of the conditioning section 146 has an input or windward side contiguous to the air inlet chamber 148 and an output or leeward side contiguous to the air outlet chamber 152. The conditioning section 146 of the casing 140 is formed with an opening 160 through which the air outlet chamber 152 is horizontally open into a passageway in a bellows-type duct 162 extending from the opening 160 and terminating above the upper face of the ceiling panel 20. The ceiling panel 20 is formed with an opening 164 and has fixedly mounted thereon a diffuser 166 providing communication between the duct 162 and the space to be air conditioned through the opening 164. On the other hand, the air inlet chamber 148' of the heat-transfer chamber 146' is open to the ceiling chamber 18 through a grille 168. The heat-exchange chamber 150' of the heat-transfer section 146' has an input or windward side contiguous to the air inlet chamber 148' and an output or leeward side contiguous to the air outlet chamber 152' which is horizontally open to the ceiling chamber 18 through a grille 170. The air inlet chambers 148 and 148' of the sections 146 and 146' have accommodated therewithin axial-flow fans 172 and 172', respectively, which are rotatably about horizontal axes in line with each other. The fans 172 and 172' are driven for rotation by means of a motor 174 fixedly supported by the partition member 144 as shown. Heat-exchangers 176 and 176' are positioned within the heat-exchange chambers 150 and 150' of the sections 146 and 146', respectively. These heat-exchangers 176 and 176' are arranged similarly to the previously described heat-exchangers 78 and 94 of the embodiment illustrated in FIG. 2. The heat-exchanger 176 in the conditioning section 146 thus acts as a refrigerant evaporator during the cooling cycle of the conditioning unit and as a refrigerant condenser during the heating cycle of the unit, while the heat-exchanger 176' of the heat-transfer section 146' acts as a refrigerant condenser during the cooling cycle of the conditioning unit and as a refrigerant evaporator during the heating cycle of the unit. At the bottoms of the heat-exchange and air outlet chambers 150 and 152 of the conditioning section 146 are positioned water condensate collecting and vaporizing basins or open-top vessels 178 and 180, respectively. At the bottoms of the heat exchange and air outlet chambers 150' ad 152' of the heat-transfer section 146' are, likewise, positioned water condensate collecting and vaporizing basins or open-top vessels 178' and 180', respectively. The collecting basin 178 in the conditioning section 146 is in communication with the vaporizing basin 180' in the heat-transfer section 146' through a conduit 182 and, likewise, the collecting basin 178' in the heat-transfer section 146 is in communication with the vaporizing basin 180 in the conditioning section 146 through a conduit 182'. Each of the conduits 182 and 182' is open at both ends into the bottoms of the basins interconnected by the conduit and is slightly sloped partly or throughout its length downwardly from the collecting basin toward the vaporizing basin as shown. The collecting basins 178 and 178' are located immediately below the heat-exchangers 176 and 176' of the conditioning and heat-transfer sections 146 and 146', respectively, so that water condensate produced on to each of the heat-exchangers 176 and 176' is collected in each of the basins 178 and 178' especially when the heat-exchanger acts as a refrigerant evaporator. Over the vaporizing basins 180 and 180' of the sections 146 and 146' are positioned wind deflecting plates 184 and 184' for forcibly guiding respective portions of streams of air issuing from the heat-exchangers 176 and 176' in the sections 146 and 146', respectively, similarly to the wind deflecting plate 102 provided in the embodiment illustrated in FIG. 2. The vaporizing basins 180 180' are provided with hot pipes 186 and 186' and electric heaters 188 and 188', respectively. Each of the hot pipes 186 and 186' and each of the electric heaters 188 and 188' are arranged similarly to their counterparts in the embodiment shown in FIG. 2 and, thus, no further description regarding the arrangements thereof will be herein incorporated. Designated by reference numeral 190 is a humidifier which may be disposed within the air outlet chamber 152 of the conditioning section 146 for the purpose of humidifying air to be fed in to the space to be conditioned when the conditioning unit is operated on the heating cycle.

During the cooling cycle of the conditioning unit when the heat-exchangers 176 and 176' of the conditioning and heat-transfer sections 146 and 146' act as refrigerant evaporator and condenser, respectively, the water condensate produced onto the heat-exchanger 176 in the conditioning section 146 is collected in the collecting basin 178 below the heat-exchanger 176 and is conducted through the conduit 182 into the vaporizing basin 180' in the heat-transfer section 146' for being vaporized and withdrawn as water vapor out of the air outlet chamber 182' of the heat-transfer section 146'. When, on the other hand, the heat-exchangers 176 and 176' in the conditioning and heat-transfer sections 146 and 146' act as refrigerant condenser and evaporator, respectively, during the heating cycle of the conditioning unit, the water condensate produced onto the heat-exchanger 176' in the heat-transfer section 146' is collected in the collecting basin 178' and is conducted through the conduit 182' into the vaporizing basin 180 in the conditioning section 146. The water thus stored in the vaporizing basin 180 is evaporated and humidifies air being passed from the air outlet chamber 152 through the passageway in the bellow-type duct 162 into the space to be air conditioned. The air thus passed through the air outlet chamber 152 is further humidified by the humidifier 190 which is partly immersed in the water stored in the vaporizing basin 180 and partly positioned over the surface of the water as indicated by dotted lines. The condensate vaporizing arrangement of the embodiment shown in FIG. 5 is thus adapted not only to vaporize and discharge the water condensate produced onto the heat-exchanger 176 in the conditioning section 146 during the cooling cycle of the conditioning unit but to humidify air to be passed to the space to be air conditioned during the heating cycle of the conditioning unit.

While several embodiments of the present invention have thus far been described with reference to the drawings, it should be borne in mind that such are merely for the purpose of illustration and may therefore be changed and modified in numerous manners if desired.

What is claimed is:

1. A method of re-conditioning air supplied by a central air conditioning system and circulated through a space to be air conditioned in a building having a ceiling chamber over said space, comprising (1) producing a continuous stream of a refrigerant through a closed loop having cycles to evaporate and condense said refrigerant, (2) withdrawing out of said space into said ceiling chamber the air which has been circulated through said space, (3) inducing a first forced circulation of air within said ceiling chamber, (4) exchanging heat between said circulation of air and said stream of the refrigerant, (5) inducing a second forced circulation of air out of said space and back into the space separately of said first forced circulation of air, (6) exchanging heat between said second forced circulation of air and the stream of the refrigerant which has exchanged heat with said first forced circulation of air, (7) collecting water condensate produced by the evaporation of said refrigerant, (8) bringing the collected water condensate into heat-conductive contact with the heat resulting from the condensation of said refrigerant for vaporizing the water condensate in said ceiling chamber and (9) withdrawing the resultant water vapor out of said ceiling chamber by means of said first forced circulation of air.

2. A method as set forth in claim 1, in which said collected water condensate is conducted to the leeward side of said first forced circulation of air for being blown with the first forced circulation of air.

3. A method as set forth in claim 2, in which said first forced circulation of air is at least in part directed toward the water condensate conducted to the leeward side of the first forced circulation of air.

4. A method as set forth in claim 3, further comprising forcibly deflecting a portion of said first forced circulation of air toward the water condensate conducted to said leeward side of the first forced circulation of air.

5. The method as set forth in claim 2, in which said first forced circulation of air is totally directed toward the water condensate conducted to said leeward side of said first forced circulation of air.

6. A method as set forth in claim 2, in which heat generated in said closed loop is at least in part passed through the water condensate conducted to said leeward side of said first forced circulation of air.

7. A method as set forth in claim 2, further comprising detecting an impending overflow condition of the water condensate conducted to said leeward side of said first forced circulation of air and passing heat from an external source through the water condensate conducted to said leeward side of said first forced circulation of air.

8. An air conditioning unit for use with a central air conditioning system for installation in a building having at least one space to be air conditioned and a ceiling structure formed with a ceiling chamber between upper and lower horizontal members and provided with means for withdrawing out of said space into said ceiling chamber the air which has been circulated through said space, comprising an air-to-air heat pump including a closed loop filled with a refrigerant and having cycles to evaporate and condense the refrigerant, first circulation inducing means for inducing a first forced circulation of air within said ceiling chamber, second circulation inducing means for inducing a second forced circulation of air out of said space and back into the space, first heat exchange means for exchanging heat between said first forced circulation of air and the stream of the refrigerant continuously circulated through said closed loop, second heat exchange means for exchanging heat between said second forced circulation of air and the refrigerant which has exchanged heat with said first forced circulation of air, collecting means for collecting water condensate produced by the evaporation of said refrigerant, and vaporizing means for bringing the collected water condensate into heat-conductive contact with the heat resulting from the condensation of the refrigerant for vaporizing the water condensate, said first circulation inducing means and said vaporizing means being positioned within said ceiling chamber.

9. An air conditioning unit as set forth in claim 8, in which said vaporizing means comprise an open-top vessel located on the leeward side of said first circulation inducing means and communicating with said collecting means for storing therein the water condensate collected by said collecting means with the surface of the water in the vessel exposed to the first forced circulation of air.

10. An air conditioning unit as set forth in claim 9, in which said vaporizing means further comprise a wind deflecting plate positioned over said open-top vessel for forcibly conducting a portion of said first forced circulation of air toward the surface of the water stored in said vessel.

11. An air conditioning unit as set forth in claim 9, in which said vaporizing means further comprise a hot pipe positioned within said vessel and connected to said loop for passing therethrough the stream of the refrigerant heated by the condensation of the refrigerant.

12. An air conditioning unit as set forth in claim 9, in which said vaporizing means further comprise electric heating element positioned within said vessel, said heating element being responsive to an impending overflow condition of the water out of said vessel for heating and vaporizing the water until the impending overflow condition is remedied.

13. An air conditioning unit as set forth in claim 9, in which said first circulation inducing means is positioned over said open-top vessel for directing said first forced circulation of air downwardly toward the surface of the water stored in the vessel.

14. An air conditioning unit as set forth in claim 8, in which said first heat exchange means is located on the windward side of said first circulation inducing means.

15. An air conditioning unit as set forth in claim 14, in which said first circulation inducing means comprise a centrifugal fan having a horizontal axis of rotation and located sidewise of the windward side of said first heat exchange means and above said vaporizing means.

16.. An air conditioning unit as set forth in claim 8, in which said first heat exchange means is located on the leeward side of said first circulation inducing means.

17. An air conditioning unit as set forth in claim 16, in which said first heat exchange means is positioned above said vaporizing with its leeward side directed downward and in which said first circulation inducing means comprise an axial-flow fan having a vertical axis of rotation and positioned over the windward side of said first circulation inducing means.

18. An air conditioning unit as set forth in claim 8, in which said collecting means comprise first and second open-top condensate collecting vessels located below said first and second heat exchange means, respectively, and in which said vaporizing means comprise first and second open-top water vaporizing vessels located on the leeward sides of said first and second heat exchange means respectively and in communication with said second and first open-top condensate collecting vessels, respectively, for storing therein the water condensates collected by the second and first collecting vessels, respectively, with the surfaces of the water in the first and second water vaporizing vessels exposed to the first and second forced circulations of air.

* * * * *